US011724295B2

(12) United States Patent
Houot et al.

(10) Patent No.: US 11,724,295 B2
(45) Date of Patent: Aug. 15, 2023

(54) STEEL SECTION ROLLING MILL

(71) Applicant: ArcelorMittal, Luxembourg (LU)

(72) Inventors: Romain Houot, Esch sur Alzette (LU); Francois Mary, Esch sur Alzette (LU); Patrick Mas, Esch sur Alzette (LU); Gilles Brosius, Esch sur Alzette (LU); Pierre Didier, Esch sur Alzette (LU); Stephane Boul, Esch sur Alzette (LU)

(73) Assignee: ARCELORMITTAL, Luxembourg (LU)

( * ) Notice: Subject to any disclaimer, the term of this patent is extended or adjusted under 35 U.S.C. 154(b) by 311 days.

(21) Appl. No.: 16/955,247

(22) PCT Filed: Dec. 19, 2018

(86) PCT No.: PCT/IB2018/060349
§ 371 (c)(1),
(2) Date: Jun. 18, 2020

(87) PCT Pub. No.: WO2019/123320
PCT Pub. Date: Jun. 27, 2019

(65) Prior Publication Data

US 2020/0391264 A1 Dec. 17, 2020

(30) Foreign Application Priority Data

Dec. 22, 2017 (WO) ..... PCT/IB2017/058332

(51) Int. Cl.
*B21B 45/00* (2006.01)
*B21B 45/02* (2006.01)
(Continued)

(52) U.S. Cl.
CPC ..... *B21B 45/0209* (2013.01); *B21B 1/088* (2013.01); *B21B 1/14* (2013.01)

(58) Field of Classification Search
CPC . B21B 45/02; B21B 45/0203; B21B 45/0206; B21B 45/0209; B21B 45/0215; B21B 45/0233; B21B 37/74
See application file for complete search history.

(56) References Cited

U.S. PATENT DOCUMENTS 3,347,076 A 10/1967 Noda et al.
4,611,789 A * 9/1986 Ackert ..... C21D 9/04 266/90
6,170,284 B1 * 1/2001 Stodt ..... C21D 1/02 62/373

FOREIGN PATENT DOCUMENTS

CN 2005238252 A 9/2005
CN 101422786 5/2009
(Continued)

*Primary Examiner* — Debra M Sullivan
(74) *Attorney, Agent, or Firm* — Davidson, Davidson & Kappel, LLC

(57) ABSTRACT

A section mill (10) for the rolling of steel sections is disclosed. The section mill includes a universal mill stand (12) and an edger mill stand (14) for rolling a workpiece (18) in a plurality of back-and-forth passes into a steel section having a web and one or more flanges. The section mill further includes a cooling arrangement (16) for cooling the workpiece while it undergoes rolling during one or more of the passes. The cooling arrangement includes a cooling box (20) having a spray head (21) with spray openings (22) for spraying jets of pressurized cooling liquid against the workpiece. The cooling arrangement further includes an actuator (38, 34) configured to move the cooling box relative to the stand frame (58) of the universal mill stand and/or of the edger mill stand for adjusting a distance between the spray openings and the workpiece.

20 Claims, 6 Drawing Sheets

(51) Int. Cl.
*B21B 1/088* (2006.01)
*B21B 1/14* (2006.01)

(56) References Cited

FOREIGN PATENT DOCUMENTS

| | | | |
|---|---|---|---|
| CN | 101767113 | A | 7/2010 |
| CN | 102363161 | A | 2/2012 |
| CN | 102755999 | | 10/2012 |
| CN | 103157678 | A | 6/2013 |
| CN | 105798071 | A | 7/2016 |
| CN | 105798071 | A | 7/2016 |
| JP | S4120336 | B1 | 1/1966 |
| JP | S55156603 | A | 12/1980 |
| JP | S5888294 | A | 5/1983 |
| JP | S6254519 | | 3/1987 |
| JP | H07103386 | A | 4/1995 |
| JP | H07155823 | A | 6/1995 |
| JP | 2000312912 | A | 11/2000 |
| JP | 2001191107 | A | 7/2001 |
| JP | 2001347306 | A | 12/2001 |
| JP | 2003019510 | A | 1/2003 |
| JP | 2006281220 | A | 10/2006 |
| JP | 2007296574 | A | 11/2007 |
| RU | 2288045 | C1 | 11/2006 |
| RU | 2288046 | C9 | 3/2007 |
| SU | 980893 | A1 | 12/1982 |

* cited by examiner

STEEL SECTION ROLLING MILL

FIELD OF THE INVENTION

The invention generally relates to a section mill for the rolling of steel sections, in particular for steel sections comprising a web and one or more flanges joined to the web, e.g. T-, U- or H-shaped steel sections. The invention relates more specifically to a cooling arrangement for locally cooling the workpiece while it is rolled.

BACKGROUND

Sectional steel having a relatively complicated cross-section, such as a T- or H-shape, or a shape derived from these base shapes, may show an undesired temperature distribution before and during the rolling process. The temperature difference between thinner portions (e.g. the flange ends in some sections) and thicker portions (e.g. at the junction of the web and a flange) may be as high as about 100 to 200° C. These temperature differentials result in non-uniform microstructure within the steel section, non-uniform mechanical properties and, possibly, in unwanted deformations (bending, fissures or cracks) of the steel section.

To address this problem, the so-called selective cooling process was devised in the 1980s. In this process, the thicker areas of the section are selectively cooled at the roughing and/or intermediate rolling stage(s) so that finishing rolling is performed when the section is of a uniform and lower temperature (e.g. of about 850° C.). Selective cooling is carried out by directing water jets to the areas to be cooled before and/or after individual rolling passes. The cooling arrangements (spray nozzles mounted on longitudinal guides) are located in dedicated zones adjacent the rolling mill. To cool a workpiece, it has to be moved out of the rolling mill and into the cooling zone, where it remains for the time it is cooled. Then the workpiece undergoes the next rolling pass (in the reverse direction).

The existing selective cooling processes require the workpiece to be completely moved out of the rolling mill for cooling. Furthermore, between two rolling passes, the workpiece has to remain in the cooling zone for a certain waiting time. Due to the additional transit and waiting times, the overall rolling time increases and the productivity of the rolling mill may decrease. Furthermore, the investments for the installation of the cooling zones are relatively important and their maintenance increases the operational costs of the rolling mill.

Chinese patent application CN 102755999 discloses an inter-stand cooling device for hot-rolled H-section steel comprising a plurality of cooling sections arranged symmetrically on the two sides of a stand of a rolling mill. A similar cooling arrangement and process is disclosed in Chinese patent application CN 101422786. These systems have in common that the integration of the cooling equipment between the stands of the rolling mill allows better utilization of the available space. Furthermore, according to CN 101422786, the original production pace can be maintained.

While cooling arrangements as disclosed in CN 102755999 and CN 101422786 may increase productivity, there is room for improvement, in particular in terms of versatility and ease of maintenance.

SUMMARY OF THE INVENTION

A first inventive aspect of the invention pertains to a section mill for the rolling of steel sections, comprising (at least) a universal mill stand and an edger mill stand for rolling a workpiece in a plurality of back-and-forth passes into a steel section having a web and one or more flanges. The section mill further comprises a cooling arrangement, mounted to the stand frame of the edger mill stand or the universal mill stand, for cooling the workpiece while it undergoes rolling during one or more of the passes. The cooling arrangement comprises a cooling box having a spray head with spray openings for spraying jets of pressurized cooling liquid (e.g. water) against the workpiece. The cooling arrangement further comprises an actuator configured to move the cooling box relative to the stand frame of the universal mill stand and/or of the edger mill stand for adjusting a distance between the spray openings and the workpiece.

It is a noteworthy advantage of the cooling arrangement that the distance between the spray openings and the workpiece can be easily adjusted. It should be noted that the dimensions of the workpiece may change from pass to pass. In some applications, the optimal distance may, e.g., amount to about 3 cm with a tolerance of ±0.5 cm, while the workpiece could be compressed or stretched in width by several centimeters. Accordingly, the possibility of adjusting the distance between the spray head and the workpiece to the optimal value will be highly appreciated.

Another advantage of carrying out the spray cooling in or between the stands of a section mill is that the workpiece is well constrained in lateral position. This is not necessarily the case in a dedicated cooling zone. Accordingly, a comparatively small spraying distance may be achieved thanks to the invention without taking an increased risk that the cooling arrangement is damaged due to a collision with the workpiece.

It will be appreciated that the cooling arrangement may be a selective cooling arrangement in the sense that it is configured for selectively cooling (only) certain portions of the workpiece, e.g. the joint between the web and a flange, an entire flange, areas of locally increased thickness, etc. The cooling boxes of the cooling arrangement are preferably arranged so as to locally cool (only) the specific portions, e.g., the one or more flanges as a whole or where they are joined to the web only.

According to an embodiment of the invention, the actuator may be part of a translation mechanism, e.g., a translation mechanism that constrains the motion of the cooling box to a translation in the plane of the web of the workpiece.

For facilitating maintenance or exchange, the cooling box is preferably fitted releasably to the actuator. Advantageously, the cooling box comprises a quick-lock fitting for connecting the cooling box to a cooling liquid supply and/or one or more quick-lock couplers for releasable locking engagement with the actuator.

For even more flexibility, the spray head may be configured removable. In that case, the spray head could be replaced with another one without the need for replacing the entire cooling box. Spray heads with different configurations (in terms of, e.g., height, length, density of the spray openings, dimensions of the spray openings etc.) could thus be used on the same cooling box. It may be worthwhile noting that the choice of the spray head may be made depending on the steel section to roll.

According to a particularly preferred embodiment of the invention, the cooling box is mounted to the stand frame in lieu of a flange roll, a pusher (e.g. one or more hydraulic cylinders) arranged on the stand frame for pressing the replaced flange roll against the workpiece being used as the actuator and the cooling box being connected to the cooling liquid supply of the replaced flange roll. What is particularly interesting in this embodiment of the invention is the ease of mounting the cooling box. No additional frame is needed for the cooling arrangement and, furthermore, the existing cooling liquid supply of the mill stands can be used. A further advantage lies in the fact that the mechanism for positioning the flange roll provides the degrees of freedom that are sufficient for correctly positioning the cooling box relative to the workpiece.

Typically, in an edger mill stand or a universal mill stand, the rolls are rotatably mounted on so-called roll chocks. The roll chocks are supports that can be moved with the roll mounted therein inter alia to regulate the pressure between the roll and the workpiece. The roll chocks are typically fixed on the stand frame via hydraulic cylinders. These hydraulic cylinders typically comprise loading cylinders, which exert the pressure on the rolls necessary for deforming the workpiece, and one or more balancing cylinders, which maintains the roll chock in contact with the loading cylinders by pulling in the opposite direction.

Preferably the cooling box is mounted to the stand frame in lieu of the roll chock of the flange roll (and of the flange roll itself).

The actuator for moving the cooling box relative to the stand frame may be or comprise a hydraulic actuator (e.g. a hydraulic cylinder), a pneumatic actuator, an electric actuator or, for manual adjustment of the distance, a mechanical actuator. If the cooling box is mounted in lieu of a roll chock, the actuator preferably comprises the loading cylinders of the roll chock.

Preferably, the actuator is remotely controllable from a control center. It will be appreciated that in modern rolling mills, this is already the case for the loading and balancing cylinders of the roll chocks. Accordingly, an embodiment, wherein the cooling box is mounted in lieu of a roll chock is particularly advantageous.

The section mill according to the first aspect of the invention may be configured for the rolling of any steel section having a web and one or more flanges, e.g. a T-, U-, or H-shaped section. Of particular interest may be a section mill configured for the rolling of H-shaped steel sections having a web and two flanges, which comprises at least one cooling arrangement arranged on each side of the section mill so as to locally cool the flanges where they are joined to the web.

A second aspect of the invention relates to a cooling box for a cooling arrangement configured to be mounted to the stand frame of the edger mill stand or the universal mill stand of a section mill as generally described hereinabove. Such a cooling box preferably comprises

- a spray head with spray openings for spraying jets of pressurized cooling liquid against the workpiece;
- one or more couplers (preferably quick-lock couplers) for releasable locking engagement with the actuator of the cooling arrangement configured to move the cooling box relative to the stand frame of the universal mill stand and/or of the edger mill stand for adjusting a distance between the spray openings and the workpiece; and
- a fitting (preferably a quick-lock fitting) for connecting the cooling box to a cooling liquid supply.

Preferably, the one or more couplers are quick-lock couplers and/or the fitting is a quick-lock fitting. As used herein, the term "quick-lock" qualifies a fitting or a coupler that locks itself automatically to its counterpart upon engagement.

The coupling elements of the cooling box (e.g. the quick-lock couplers and fitting) are preferably configured for connection with the loading and balancing cylinders and the cooling water supply of a roll chock. The fact that the existing water supply of the replaced roll chock can be used constitutes an interesting advantage, since it is not necessary to install an additional water supply in the rolling mill.

According to a preferred embodiment, the cooling box is configured stackable between a lower horizontal roll chock and an upper horizontal roll chock. Stackability can be achieved by configuring (in particular in terms of dimensions and weight carrying capacity) the cooling box like the roll chock that is replaced. In certain rolling mills, the rolls (and the corresponding chocks) of a rolling stand are stacked on a trolley, which is introduced into the stand. The rolls mounted in their chock are then lifted from the trolley and brought into position in the stand. Depending on the type of the mill stand, the trolley remains in the stand or is driven out of the stand. To remove the rolls from the stand, the procedure is carried out in the reverse order. If the cooling box is configured stackable, it can be mounted to the stand frame as easily as a flange roll in its chock. Preferably, the cooling box comprises one or more mounts on its upper side for supporting a horizontal roll chock (i.e. the chock of the upper horizontal roll).

Due to the cooling box being as easily removable from the mill stand as the rolls, there is no loss of time to be expected in comparison to a conventional section mill. Accordingly, there is no increase in down times due to mounting and dismounting the cooling arrangements.

A method of rolling steel sections may comprise

- rolling a workpiece in a section mill comprising a universal mill stand and an edger mill stand, the rolling being carried out in a plurality of back-and-forth passes to produce a steel section having a web and one or more flanges;
- (locally) cooling the workpiece while it undergoes rolling during one or more of the passes (i.e. not in-between two subsequent passes), the cooling comprising spraying jets of pressurized cooling liquid against the workpiece using a cooling arrangement comprising a cooling box with spray openings for spraying the jets.

The cooling arrangement used for the cooling comprises an actuator configured to move the cooling box relative to the stand frame of the universal mill stand and/or of the edger mill stand for adjusting a distance between the spray openings and the workpiece.

The steel section rolling method may further comprise adjusting the distance by activating the actuator. It may be worthwhile noting that the cooling arrangement disclosed herein facilitates adjusting the distance between the cooling box and the workpiece from pass to pass or even during a pass, when necessary.

A third aspect of the invention relates to a method of retrofitting a section mill with a cooling arrangement, the section mill being configured for the rolling of steel sections and comprising a universal mill stand and an edger mill stand for rolling a workpiece in a plurality of back-and-forth passes into a steel section having a web and one or more flanges. The method of retrofitting comprises:

- providing a cooling box comprising spray openings for spraying jets of pressurized cooling liquid against the workpiece;
- mounting the cooling box to the universal mill stand or the edger mill stand in lieu of a flange roll (possibly in lieu of the flange roll and its roll chock) and fitting the cooling box to a pusher (e.g. an arrangement of loading and balancing cylinders) arranged on the stand frame for pressing the flange roll against the workpiece;

connecting the cooling box to a cooling liquid supply of the flange roll; and using the pusher as an actuator for moving the cooling box relative to the stand frame of the universal mill stand and/or of the edger mill stand for adjusting a distance between the spray openings and the workpiece.

BRIEF DESCRIPTION OF THE DRAWINGS

The accompanying drawings illustrate several aspects of the present invention and, together with the detailed description, serve to explain the principles thereof. In the drawings.

DETAILED DESCRIPTION OF PREFERRED EMBODIMENTS

Figure 1:
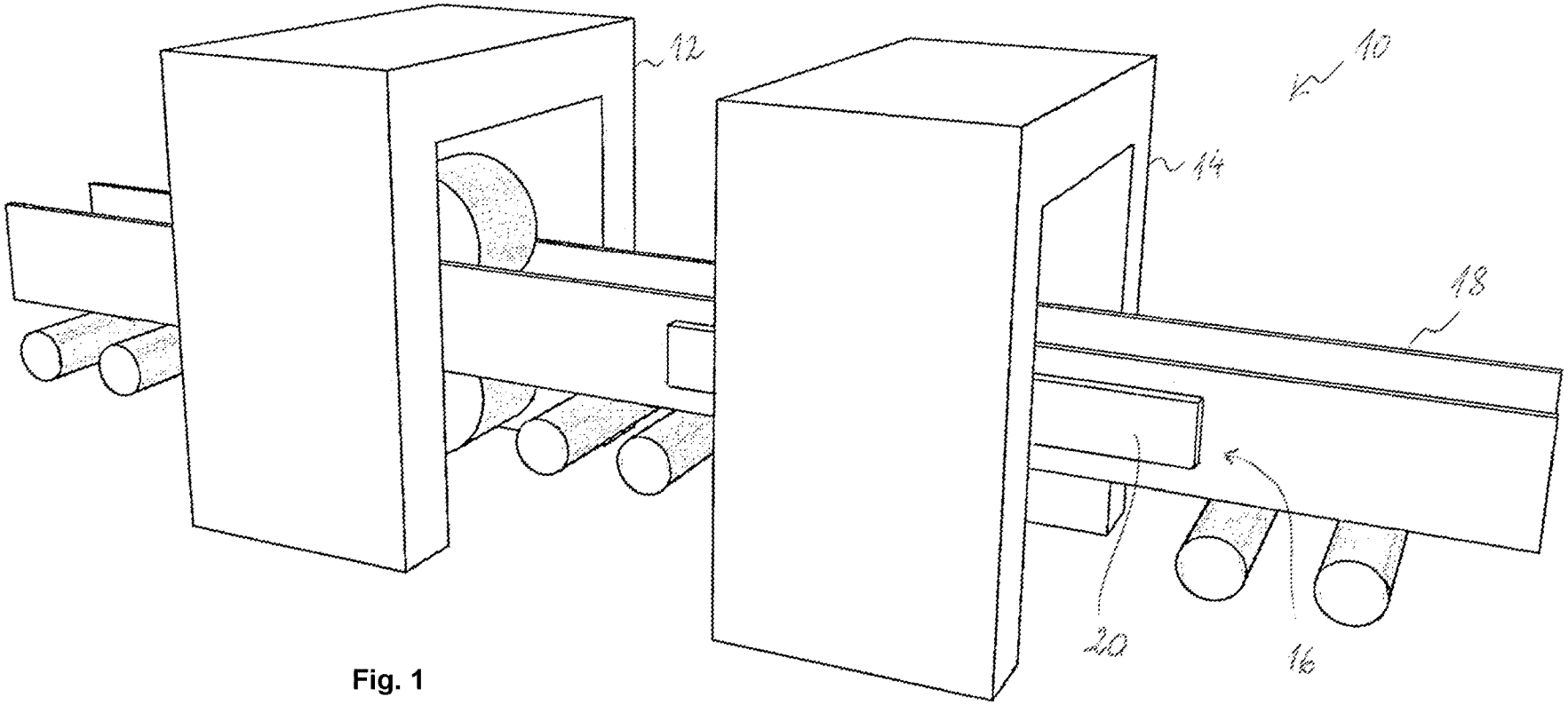
FIG. 1: is a schematic perspective view of a rolling mill according to an embodiment of the invention.

FIG. 1 schematically shows a section mill 10 rolling steel sections. Section mill 10 comprises a universal mill stand 12 and an edger mill stand 14. The edger mill stand 14 is equipped with cooling arrangements 16 for locally cooling the workpiece 18 while it is rolled. (Only one of the cooling arrangements is visible in FIG. 1, the other one is hidden by the workpiece 18.) The workpiece 18 (beam blank) is rolled into its final shape in a plurality of back-and-forth passes. In the illustrations, the workpiece 18 has an H-shaped cross-section with a web and two flanges.

Figure 2:
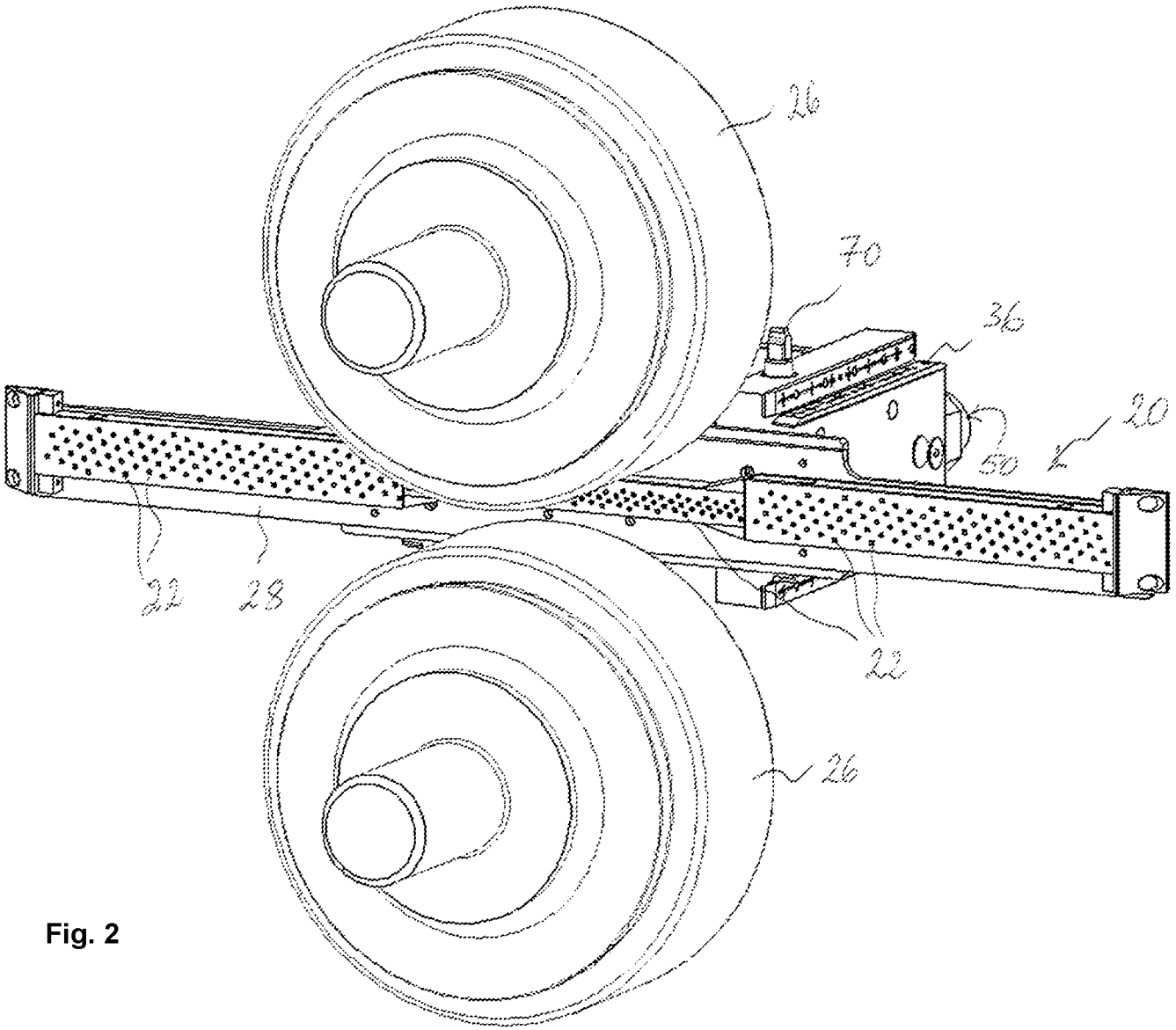
FIG. 2: is a perspective view of a cooling box as it may be positioned relative to the edger rolls of an edger mill stand.

Details of a preferred embodiment of the cooling arrangements are best contemplated with reference to FIGS. 2-5. Each cooling arrangement 16 comprises a cooling box 20 having a spray head 21 (see, e.g., FIG. 3) with spray openings 22 for spraying jets of pressurized cooling liquid 24 against the workpiece 18. FIG. 2 illustrates how the cooling box 20 is positioned relative to the edger rolls 26 of the edger mill stand 14. (The workpiece and details of the edger mill stand are not shown for the sake of clarity.) The cooling box 20 comprises a removable spray head 21 extending in the rolling direction of the section mill 10. The spray openings 22 are disposed in the spray head 21. In operation, the spray head 21 is arranged with the spray openings 22 facing the outward-oriented face of one of the flanges of the workpiece 18. The spray head 21 lies substantially in the plane of the web of the workpiece 18, so that the jets of the cooling liquid 24 are projected against the joint area between the web and the flange (best shown in FIG. 4).

Figure 3:
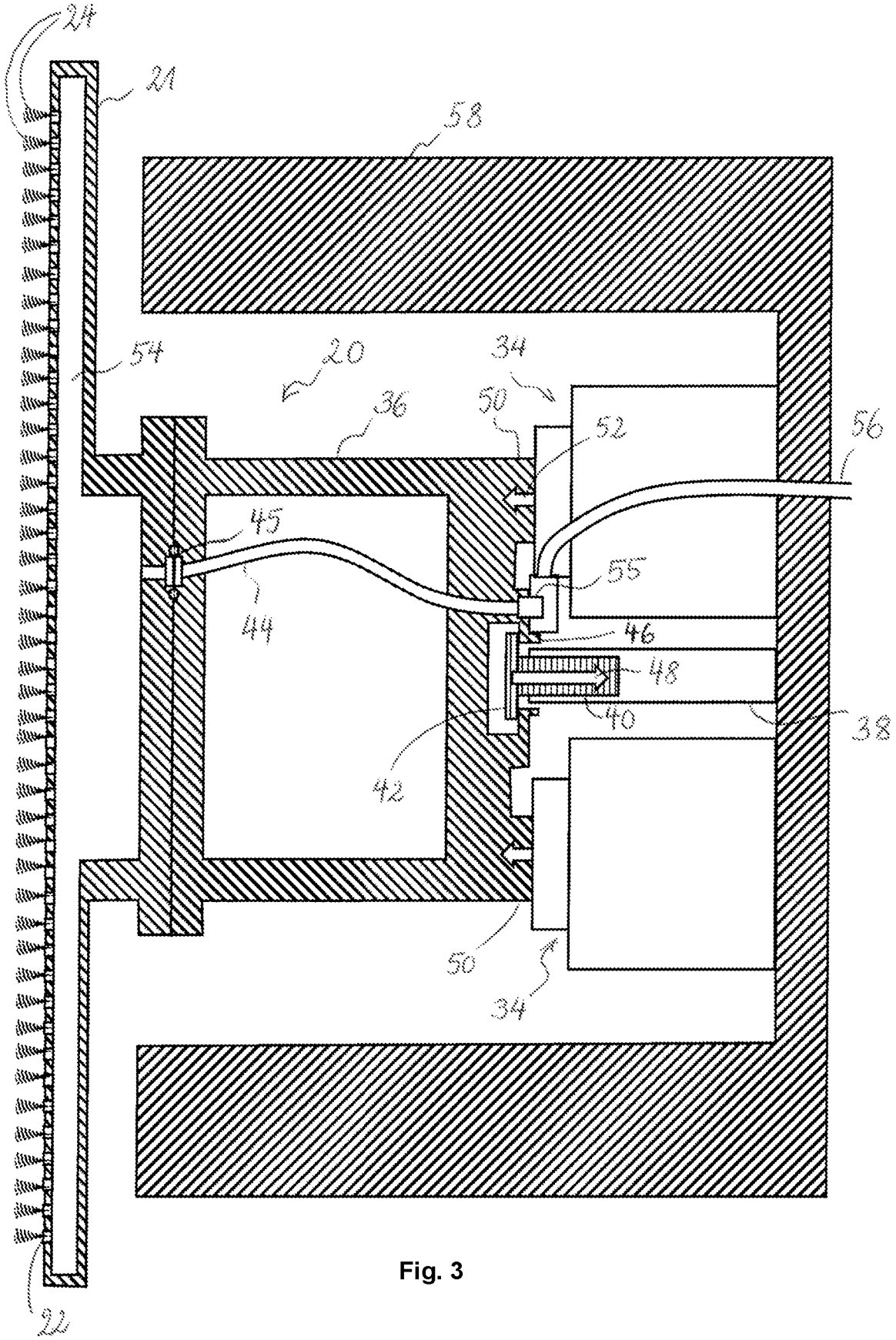
FIG. 3: is a schematic cross-sectional view of the cooling box of FIG. 2 mounted in a mill stand.
Figure 4:
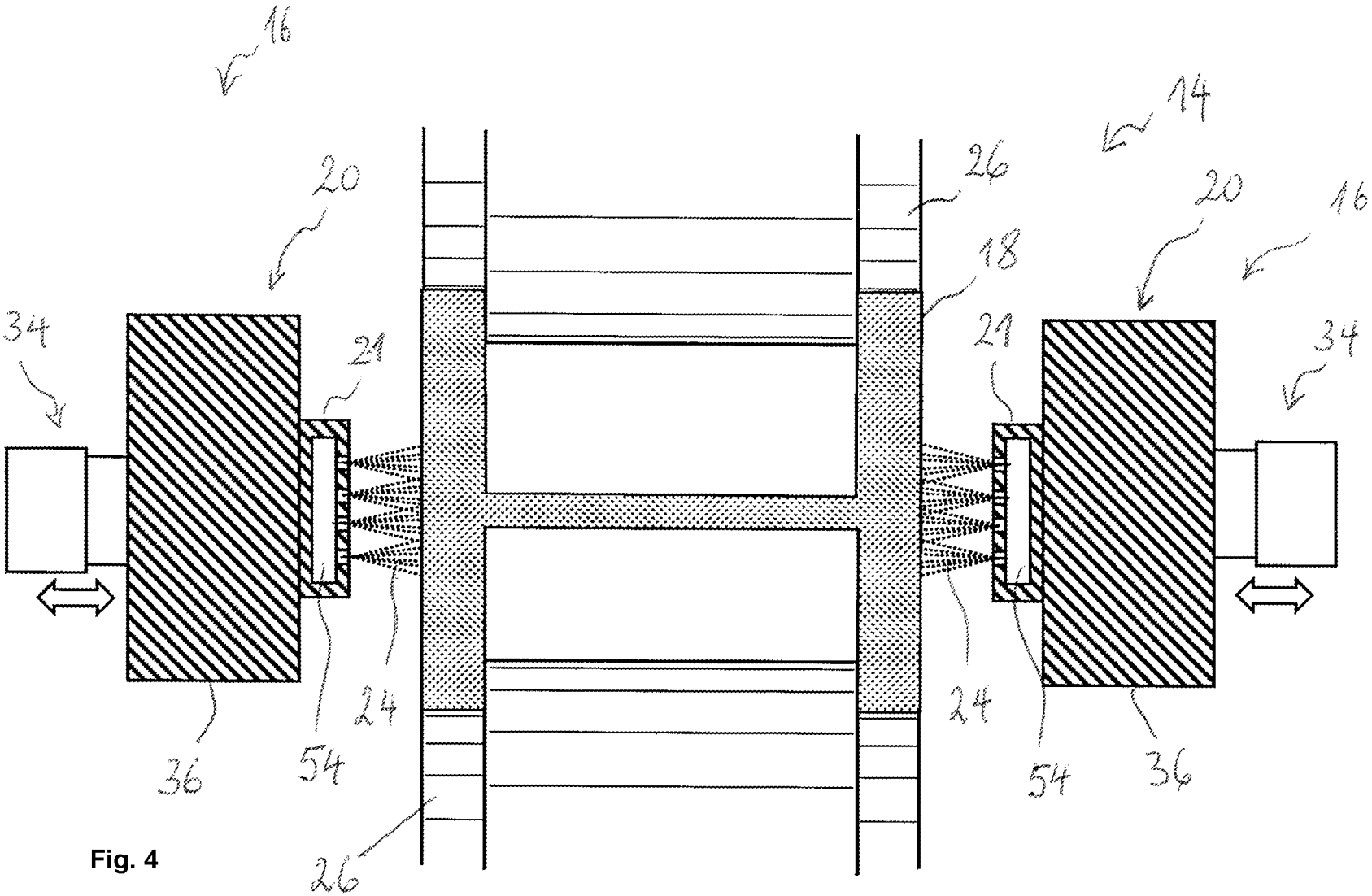
FIG. 4: is a schematic view of the edger mill stand in the rolling direction.
Figure 5:
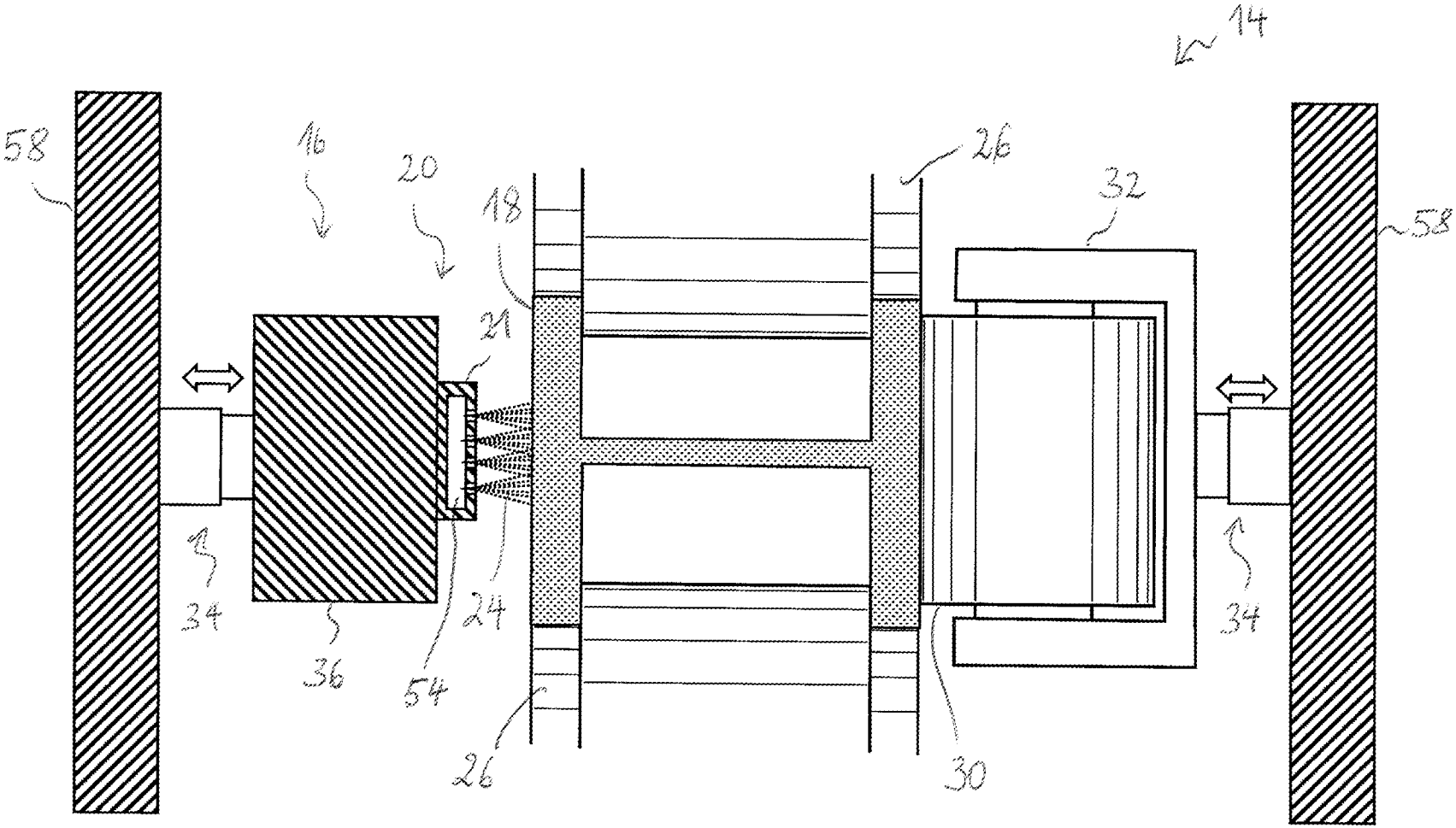
FIG. 5: is the view of FIG. 4, wherein only one flange roll and its chock have been replaced by a cooling box.

The cooling box 20 shown in FIGS. 2-5 is configured for replacing a flange roll 30 and its roll chock 32 on a mill stand. FIG. 5 schematically illustrates an edger mill stand 14, wherein one of the flange rolls 30 and the corresponding roll chock 32 are in place, whereas the others have been replaced by a cooling box 20. FIG. 4 shows the same edger mill stand, wherein both flange rolls and their roll chocks have been replaced by cooling boxes 20.

As indicated before, it is particularly advantageous to mount the cooling box 20 in lieu of a flange roll and the corresponding roll chock because the loading cylinders 34 can readily be used for positioning the cooling box 20 relative to the stand frame and thus to the workpiece. Furthermore, the cooling liquid supply provided for the cooling of the flange roll can serve to supply the cooling liquid to the cooling box 20.

As best shown in FIG. 3, the cooling box 20 comprises a support body 36, which is dimensioned so as to fit within the space otherwise occupied by the flange roll 30 and its chock 32. The spray head 21 with the spray openings 22 is mounted on the support body 36. The support body comprises a quick-lock coupling arrangement that is of the same type as that of the roll chock 32. In the illustrated embodiment, the hydraulic actuators comprise a centrally arranged balancing cylinder 38, the piston 40 of which terminates in a catch 42, and two laterally arranged loading cylinders 34. The support body 36 comprises a central coupler 46 for receiving the catch 42 and interlocking with it (e.g. by rotation of the catch 42 about the piston axis). The balancing cylinder 38 exerts a pulling force 48 on the support body 36, so as to hold the cooling box 20 in place against the loading cylinders 34. The loading cylinders 34 push against the support body 36 at abutments 50. The loading cylinders 34 are controlled in such a way as to maintain the cooling box 20 in a certain position relative to the stand frame 58 and thus to the workpiece 18. To this end, the loading cylinders 34 comprise position sensors measuring the positions of the pistons. A controller (not shown) then regulates the hydraulic pressure of the loading cylinders 34 in such a way that their pistons stay at the desired position. The balancing cylinder 38 applies a force 48 in the direction opposite to that of the forces 52 induced by the loading cylinders 34, so as to maintain the cooling box 20 permanently in contact with the loading cylinders 34.

The support body 36 also comprises a quick-lock fitting 55 (See, e.g., FIG. 5) for connecting the manifold 54 of the cooling box with the cooling liquid supply 56 of the mill stand via a coolant conduit 44.

The spray head 21 is removably attached to the support body 36 by means of screws, bolts, clamps, or the like (not shown). The joint between the manifold 54 and the coolant conduit 44 is made fluid-tight by a face-seal gasket 45.

Figure 6:
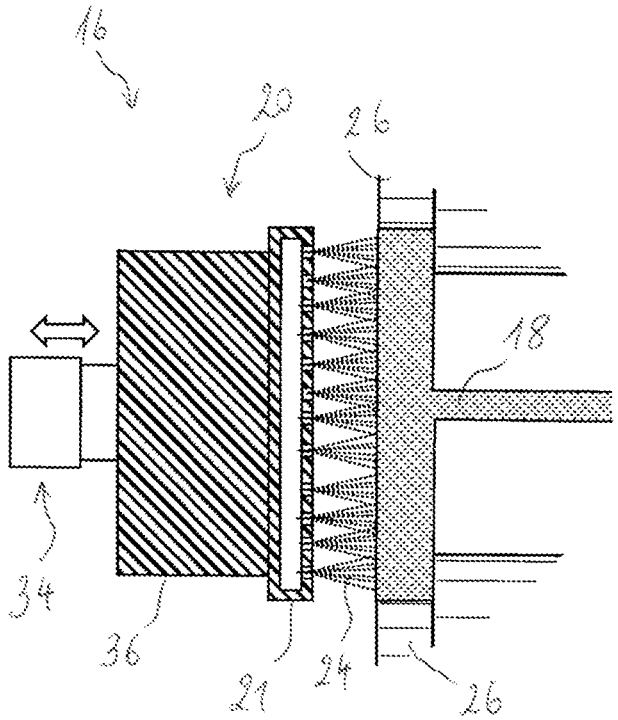
FIG. 6: is a schematic view of a cooling arrangement having a higher spray head for cooling substantially the whole flange of the workpiece.

As shown in FIG. 4, the mill stand 14 comprises a first and a second cooling arrangement 16 of the described type, for locally cooling the first and the second flange of the workpiece, respectively. FIG. 6 shows a variant of the cooling arrangements of FIG. 4, wherein the spray head 21 is configured for cooling substantially the entire outward face of the flange of the workpiece 18.

The cooling arrangements 16 are particularly useful for retrofitting a rolling mill, as the only necessary additional components are the cooling boxes configured in such a way that they can be mounted on a mill stand in lieu of a roll or of a roll in its chock. It should be noted that although in the preferred embodiment described above the cooling arrangements are mounted on an edger mill stand, they could also be mounted on a universal mill stand. Furthermore, while a solution wherein each cooling box replaces a roll within its chock is certainly preferable, a solution wherein the roll chock remains in place and only the roll is replaced by the cooling box could also be envisaged.

Figure 7:
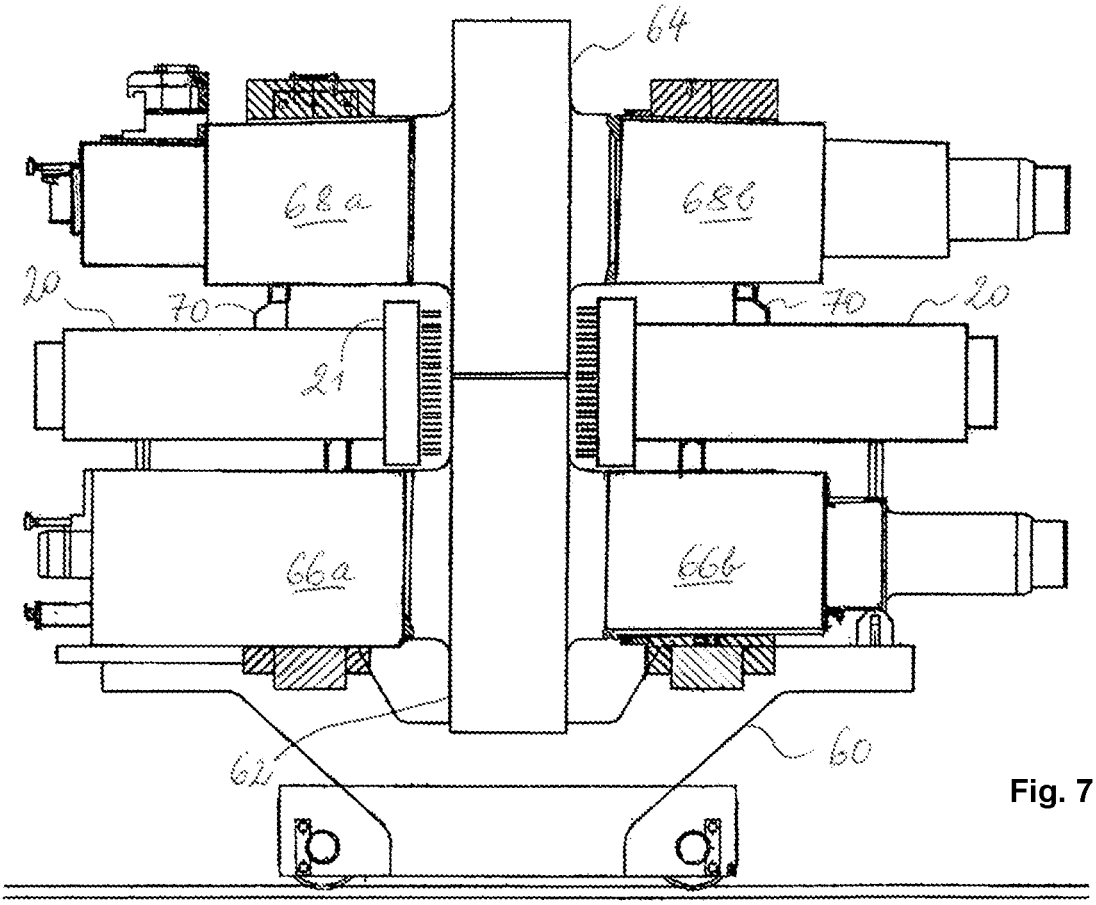
FIG. 7: is a side view of a trolley for the replacement of the rolls of a mill stand, carrying a stack of rolls, wherein cooling boxes take the positions that are conventionally those of the flange rolls in their chocks.

FIG. 7 illustrates a trolley 60 for the replacement of the rolls and chocks of a universal or edger mill. In the illustrated case, cooling boxes 20 are stacked in-between the lower 62 and upper 64 horizontal rolls in their respective chocks 66*a*, 66*b* and 68*a*, 68*b*, taking the place of the flange rolls and the corresponding chocks. To place the components on the trolley 60 into the mill stand, the latter is opened and the trolley 60 is introduced into the stand. The rolls mounted in their chocks and the cooling boxes 20 are then lifted from the trolley 60 and brought into position in the stand. Finally, the trolley 60 is driven out of the stand or remains therein. To remove the rolls and the cooling boxes 20 from the stand, the trolley is introduced, when necessary, and the procedure is carried out in the reverse order.

The cooling boxes 20 are configured stackable with the lower 62 and upper 64 horizontal rolls in their respective chocks 66*a*, 66*b* and 68*a*, 68*b*. Specifically, the cooling boxes 20 are configured such that their relevant dimensions and the load bearing capacity correspond to those of the flange roll chocks that are replaced. In the illustrated case, the cooling boxes 20 comprise mounts 70 (see also FIG. 2) arranged on their upper sides for supporting the chocks 68*a*, 68*b* of the upper horizontal roll 64.

While specific embodiments have been described herein in detail, those skilled in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

What is claimed is:

1. A section mill for rolling steel sections, comprising:

a universal mill stand; and an edger mill stand for rolling a workpiece in a plurality of back-and-forth passes into a steel section having a web and one or more flanges;

each of the universal mill stand and the edger mill stand having a stand frame;

a cooling arrangement, mounted to the stand frame of the edger mill stand or the universal mill stand, for cooling the workpiece while the workpiece undergoes rolling during one or more of the passes, the cooling arrangement including a cooling box having a spray head with spray openings for spraying jets of pressurized cooling liquid against the workpiece, the cooling arrangement including an actuator configured to move the cooling box relative to the stand frame of the universal mill stand or of the edger mill stand for adjusting a distance between the spray openings and the workpiece.

2. The section mill as recited in claim 1 further comprising a translation mechanism, the translation mechanism including the actuator.

3. The section mill as recited in claim 2 wherein the translation mechanism constrains a motion of the cooling box to a translation in the plane of the web.

4. The section mill as recited in claim 1 wherein the cooling box of the cooling arrangement is arranged so as to cool the one or more flanges as a whole or locally where joined to the web.

5. The section mill as recited in claim 1 wherein the cooling box is releasably fitted to the actuator, the cooling box including a quick-lock fitting for connecting the cooling box to a cooling liquid supply.

6. The section mill as recited in claim 1 wherein the cooling box includes at least one quick-lock coupler for releasable locking engagement with the actuator.

7. The section mill as recited in claim 1 wherein the cooling arrangement is mounted to the stand frame of the edger mill stand.

8. The section mill as recited in claim 1 wherein the cooling arrangement is mounted to the stand frame of the universal mill stand.

9. The section mill as recited in claim 1 wherein the cooling box is mounted to the stand frame of the universal mill stand or of the edger mill stand, wherein a pusher arranged on the stand frame is used as the actuator and wherein the cooling box is connected to a cooling liquid supply.

10. The section mill as recited in claim 1 wherein the cooling box is mounted to the stand frame in lieu of a flange roll or in lieu of a flange roll chock.

11. The section mill as recited in claim 1 wherein the actuator includes a hydraulic actuator, a pneumatic actuator, an electric actuator or, for manual adjustment of the distance, a mechanical actuator.

12. The section mill as recited in claim 1 wherein the actuator is remotely controllable from a control center.

13. The section mill as recited in claim 1 wherein the section mill is configured for rolling of H-shaped steel sections having the web and two flanges of the at least one flange, and includes a further cooling arrangement, the cooling arrangement and the further cooling arrangement being on each side of the section mill so as to cool the flanges as a whole or locally where the flanges are joined to the web.

14. A cooling box for a cooling arrangement configured to be mounted to a stand frame of an edger mill stand or a universal mill stand of a section mill for rolling steel sections, the edger mill stand being configured for rolling a workpiece in a plurality of back-and-forth passes into a steel section having a web and one or more flanges, wherein the cooling arrangement is mounted to the stand frame of the edger mill stand or the universal mill stand for cooling the workpiece while the workpiece undergoes rolling during one or more of the passes, the cooling box comprising:

a spray head with spray openings for spraying jets of pressurized cooling liquid against the workpiece;

at least one coupler for releasable locking engagement with an actuator of the cooling arrangement configured to move the cooling box relative to the stand frame of the universal mill stand or of the edger mill stand for adjusting a distance between the spray openings and the workpiece; and a fitting for connecting the cooling box to a cooling liquid supply.

15. The cooling box as recited in claim 14 wherein the at least one coupler includes a quick-lock coupler or wherein the fitting is a quick-lock fitting.

16. The cooling box as recited in claim 14 wherein the spray head is removable.

17. The cooling box as recited in claim 14 further comprising at least one mount on an upper side of the cooling box for supporting a horizontal roll chock.

18. The cooling box as recited in claim 14 wherein the cooling box is configured to be stackable between a lower horizontal roll chock and an upper horizontal roll chock.

19. A method of retrofitting a section mill with a cooling arrangement, wherein the section mill is configured for the rolling of steel sections and comprises a universal mill stand and an edger mill stand for rolling a workpiece in a plurality of back-and-forth passes into a steel section having a web and one or more flanges, each of the universal mill stand and the edger mill stand having a stand frame, the method comprising:

providing a cooling box comprising a spray head with spray openings for spraying jets of pressurized cooling liquid against the workpiece;

mounting the cooling box to the universal mill stand or the edger mill stand in lieu of a flange roll and fitting the cooling box to a pusher arranged on the stand frame;

connecting the cooling box to a cooling liquid supply; and using the pusher as an actuator for moving the cooling box relative to the stand frame of the universal mill stand or of the edger mill stand for adjusting a distance between the spray openings and the workpiece.

20. The method as recited in claim 19 wherein, prior to mounting the cooling box to the universal mill stand or the edger mill stand in lieu of the flange roll, the flange roll is removed from the stand frame together with a roll chock of the flange roll and wherein the cooling box is mounted on the stand frame in lieu of the roll chock.

* * * * *